United States Patent [19]

Culpepper, Jr. et al.

[11] Patent Number: 4,506,486

[45] Date of Patent: Mar. 26, 1985

[54] COMPOSITE SIDING PANEL

[75] Inventors: Bertram C. Culpepper, Jr., Fenton; Richard C. Wilson, West Bloomfield, both of Mich.

[73] Assignee: Culpepper & Wilson, Inc., Fenton, Mich.

[21] Appl. No.: 576,169

[22] Filed: Feb. 1, 1984

Related U.S. Application Data

[63] Continuation of Ser. No. 328,471, Dec. 8, 1981.

[51] Int. Cl.[3] ..... E04D 1/28

[52] U.S. Cl. ..... 52/529

[58] Field of Search ..... 52/519–522, 52/529–531, 545, 555, 556

[56] References Cited

U.S. PATENT DOCUMENTS

| | | | |
|---|---|---|---|
| 2,231,008 | 2/1941 | Ochs | 52/556 |
| 2,450,562 | 10/1948 | Robinson et al. | 52/556 |
| 3,159,943 | 12/1964 | Sugar et al. | 52/531 |
| 3,826,054 | 7/1974 | Culpepper, Jr. | 52/309 |
| 4,081,939 | 4/1978 | Culpepper, Jr. et al. | 52/535 |
| 4,388,361 | 6/1983 | Vassalli | 52/595 X |
| 4,399,643 | 8/1983 | Hafner | 52/530 |

FOREIGN PATENT DOCUMENTS

| | | | |
|---|---|---|---|
| 2015134 | 4/1970 | France | 52/529 |

*Primary Examiner*—James L. Ridgill, Jr.

*Attorney, Agent, or Firm*—Basile, Weintraub & Hanlon

[57] ABSTRACT

A composite interlocking siding panel includes an elongate sheet metal or vinyl outer panel having a nailing strip along one longitudinal edge and mating interlocking means extending along each longitudinal edge. An elongate boardlike member of insulating material is bonded to the back of the outer panel. The insulating member is so configured that it may be of any selected thickness without interfering with the installation of the composite panel on a building wall. The insulating member includes a projection extending along one longitudinal edge which projects beyond the nailing strip and is configured, when installed, to snugly fit within an undercut recess in the mating longitudinal edge of a like interlocked panel with the rear surfaces of the insulating members lying in a common plane in their finally installed position.

3 Claims, 4 Drawing Figures

COMPOSITE SIDING PANEL

This application is a continuation, of application Ser. No. 328,471, filed Dec. 8, 1981.

BACKGROUND OF THE INVENTION

The present invention is concerned with lap siding panels of the type wherein elongate siding panels of sheet metal or vinyl are formed with mating, interlocking means along their opposed longitudinal edges for interlocked installation on a building wall in imitation of conventional wooden lap siding. Panels of this type have long been known in the art. Because the panels function solely to provide a weatherproof exterior sheathing of the building and do not provide any structural support, they are conventionally made of relatively thin material which does not provide any substantial heat insulation to the building. Accordingly, it has been proposed in the prior art to back such panels with boardlike members of heat insulating material, such as expanded polystyrene foam, for example. See U.S. Pat. Nos. 3,826,054 and 4,081,939, for example.

While improvement in insulating qualities of the siding panel is thus obtained, the configuration of the metal (or vinyl) outer panels, particularly the interlocking edges, and the clearances required to enable adjacent panels to be interlocked with each other during installation, find most prior art composite panels having recesses or voids provided in the boardlike insulating member which leave internal chambers in the finally assembled and installed panels which permit thermal losses due to air infiltration, tend to collect moisture, provide nesting places for insects, or result in gaps or regions of substantially reduced thickness in the insulating material. Overall, such boardlike members have a thickness ranging between ⅜" to ½" and therefore provide little or no structural support and little insulation value to the siding panels.

The present invention is especially directed to a composite panel of the foregoing type in which a boardlike member of insulating material is bonded at the factory to the metal or vinyl outer panel and is formed with a cross-sectional configuration such that the metal and its attached insulating board are both firmly and permanently anchored to the building frame during installation, in which the insulating material does not interfere with the interlocking of a subsequent panel, and in which a substantially void-free insulating layer, which may be of any desired thickness to eliminate the need for sheathing in new construction and to afford substantially greater "R" values, is achieved behind the metal panels in the completed installation.

SUMMARY OF THE INVENTION

In accordance with the present invention, a boardlike insulating member is formed to a length equal to that of a sheet metal panel to which it is to be bonded and is formed with a transverse width which preferably slightly exceeds that of the metal panel and is slightly oversized to the extent that the longitudinal edges of the insulating members are compressed against each other when installed to provide an air-tight seal. This arrangement effectively stops thermal loss due to air infiltration. Metal panels of this type are conventionally formed in many differing cross-sections; the rear surface of the boardlike member is formed flat and, in the case of a lap-type panel, the front surface of the insulating board is formed at an inclination corresponding to that which the metal panel will assume in its installed position. Typically, the metal panel is formed with perforations along its upper longitudinal edge which function as a nailing strip to mount the panel on the building wall. The insulating board of the present invention is configured to project transversely outwardly beyond this nailing strip so that when the panel is nailed in position, the nails will pass not only through the outer metal panel, but also through the insulating board. Since the boardlike member is shaped to conform to the siding panel configuration, it provides vastly improved panel rigidity and strength.

At the opposite or lower longitudinal edge of the composite panel, the insulating board is formed with an undercut recess complementary in shape to the projecting portion at the offset longitudinal edge of the board so that when two panels are interlocked with each other in their finally installed position, the projecting portion at the upper edge of the insulating member of the lower of the two panels snugly fits within and substantially fills the recess in the board of the adjacent panel. The interlocking lips of the two metal panels interlock with each other within the recess formed in the lower edge of the insulating board of the upper panel.

Other objects and features of the invention will become apparent by reference to the following specification and to the drawings.

IN THE DRAWINGS

DESCRIPTION OF THE PREFERRED EMBODIMENT

Figure 1:
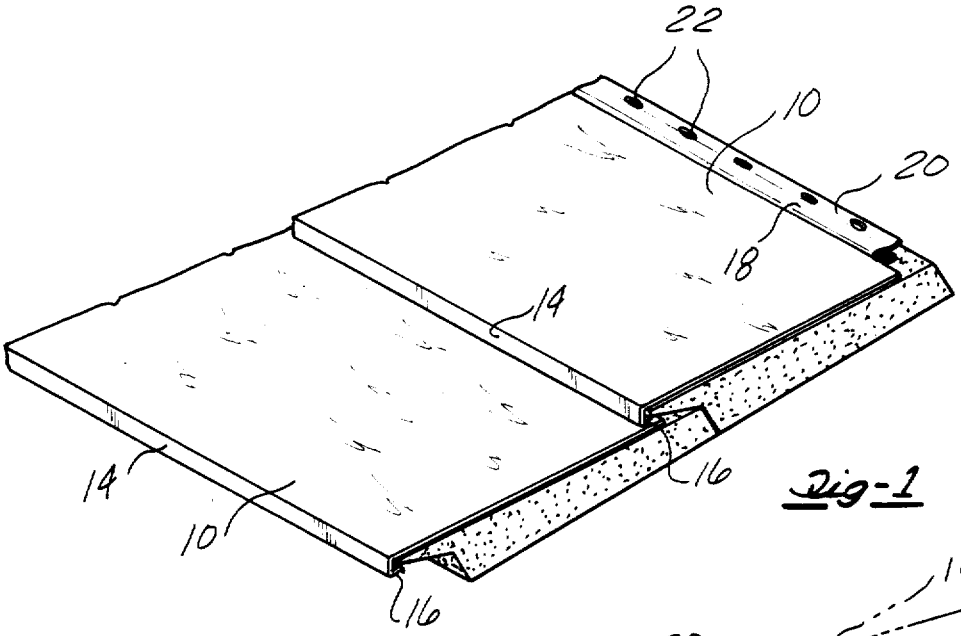
FIG. 1 is a perspective view of the end portions of two composite panels embodying the present invention showing the panels in interlocked relationship with each other.
Figure 2:
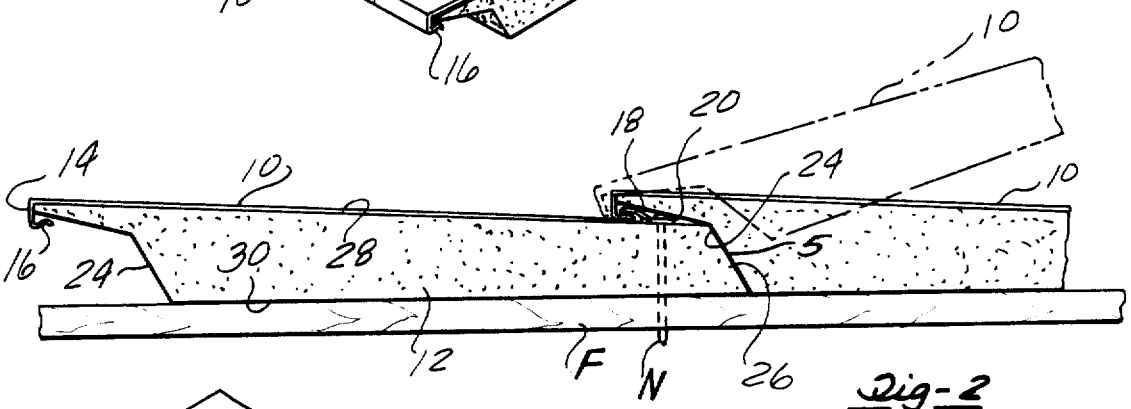
FIG. 2 is a detailed cross-sectional view of the panels of FIG. 1 in a finally installed position.

In FIGS. 1 and 2 of the drawings, a composite lap siding panel embodying the present invention is shown as including a sheet metal outer panel 10 which has a boardlike member of insulating material 12 adhesively bonded to its rear or inner surface. The metal panels 10 may take the form of any of many commercially available siding panels conventionally manufactured for direct installation per se—that is, without any insulating backing, see, for example, Chalmers U.S. Pat. No. 3,282,009. As is well known in the art, such panels are typically supplied by the manufacturer in various standard lengths, such as 10 feet, 12 feet six inches, etc.; hence, only an end portion of two panels has been shown in FIG. 1.

The particular metal panel 10 shown in FIGS. 1 and 2 is formed with an inwardly projecting lower edge 14 (left-hand edge as viewed in FIGS. 1 and 2) and an interlocking lip 16 of sinuous cross-section is integrally formed at the inner side of lower edge 14. At the opposite, or upper edge of panel 10, the panel is crimped and longitudinally folded as at 18 to define an interlocking lip extending along the upper edge of panel 10 which is adapted to receive the lip 16 of a second or like panel as best seen in FIG. 2 to interlock the two panels to each other. Immediately above (to the right as viewed in FIGS. 1 and 2) of the upper interlocking lip 18, a nailing strip 20 having a series of holes 22 (FIG. 1) is formed in panel 10. As best seen in FIG. 2, the panel is installed by means of nails N (FIG. 2) which pass through nail holes 22 in nailing strip 20, and the underlying insulating member 12 to mount the individual panel in position upon a building frame F.

As best seen in FIG. 2, the lower longitudinal edge (left-hand edge as viewed in FIG. 2) is formed with an undercut recess 24 into which the interlocking lip 16 projects. The opposite or upper edge of insulating board 12 is formed with a projection 26 which is substantially complementary in configuration to recess 24 so that when two of the composite panels of FIGS. 1 and 2 are in their finally installed position shown in FIG. 2, the projection 26 at the upper (right-hand) edge of one of the composite panels snugly fits within the recess 24 of an adjacent interlocked panel. As is apparent from FIG. 2, this arrangement results in a completed installation wherein a substantial thickness of uninterrupted and void-free insulating material is provided between the metal panels 10 and the wall or frame of the building F. The thickness of the insulating material and the stiffening action given by it to the composite panel is such that sheathing of the building on which the panels are installed is not required. Generally, the thickness of the insulating board 12 is between 1¼" to 1½".

Installation of the second or right-hand panel of FIG. 2 is performed without interference by first interlocking the panels with the right-hand panel slightly tilted as indicated in broken line in FIG. 2 and then swinging this panel into the finally installed position after interlocking has been achieved.

In a lap siding panel arrangement such as shown in FIG. 2, the main portion of the metal panel 10 is intended to be inclined downwardly and outwardly from the vertical in its finally installed position, and the inclination of the front surface 28 of insulating board 12 is correspondingly inclined, while the rear surface 30 of the board is flat and will lie in a vertical plane when installed. The effective width of member 12 is such that the opposed longitudinal side surfaces of the members are forcibly compressed against each other to form an air-tight seal along the engaged surfaces at 5 (FIG. 2) when the panels are installed.

Figure 3:
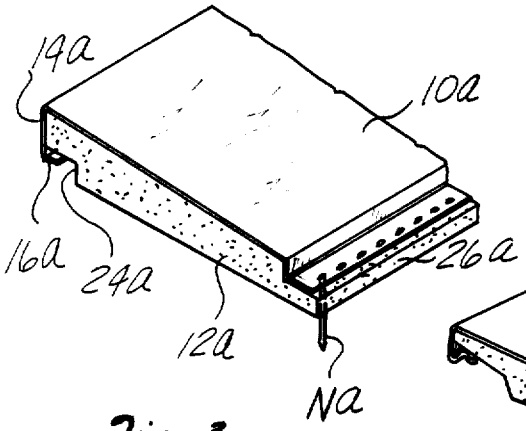
FIGS. 3 and 4 are perspective views of end portions of variant forms of composite panels embodying the present invention.
Figure 4:
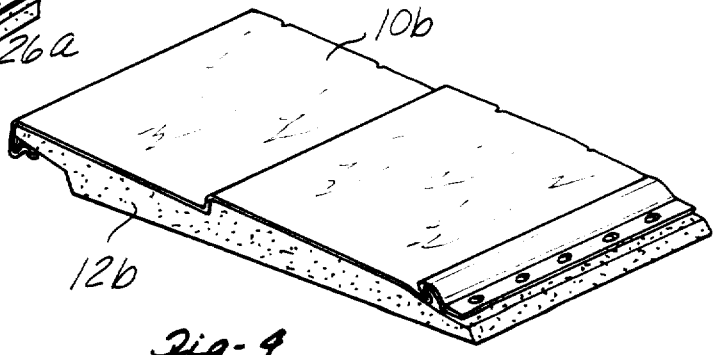

In FIGS. 3 and 4, variant shapes of metal panels 10 are shown at 10*a* (FIG. 3) and 10*b* (FIG. 4).

In the embodiment of FIG. 3, the recess 24*a* and projection 26*a* are formed with surfaces at right angles to each other, in contrast with the inclined surface of the corresponding projections and recesses of the embodiment of FIGS. 1 and 2.

The embodiment of FIG. 4 differs from that of FIG. 1 solely in that the metal panel 10*b* is a so-called "double" panel which simulates two lapped siding boards in a single composite panel is compared to the single board simulated by a panel of the embodiment of FIGS. 1 and 2. As indicated in FIG. 4, the front surface of the board-like insulating member 12*b* is formed to a shape complementary to that of the metal panel 10*b*.

While various embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

We claim:

1. A composite siding panel comprising:

an outer panel formed of a weather impervious material and having first and second spaced, longitudinally extending edges;

means defining a nailing strip on one of the first and second longitudinal edges of the outer panel for mounting the outer panel on a building;

an elongated insulating member formed of a foamed insulating material mounted on the inner surface of the outer panel, the insulating member having first and second longitudinally extending edges;

an under cut recess formed in and extending along the first longitudinal edge of the insulating member said recess having a plurality of sides of which one side forms an acute angle at the junction of said composite siding panel and building;

a projection complementary to the recess formed in and extending along the second longitudinal edge of the insulating member, the projection extending outward beyond one edge of the outer panel a greater distance than the depth of the under cut recess; and first and second interlocking means extending along opposed first and second longitudinal edges of the outer panel for interlocking outer panels of two adjacent panels in parallel, abutting relationship, the first interlocking means being disposed within the recess in the insulating member;

the width of the insulating member being greater than the width of the outer panel by a pre-determined amount such that the adjacent longitudinal edges of two insulating members are compressed against each other upon the interlocking of two adjacent siding panels to which the insulating members are mounted.

2. The invention defined in claim 1 wherein said projection on said insulating member underlies said nailing strip and said one of said longitudinal edges of said outer panel.

3. The invention defined in claim 1 wherein the first interlocking means on said outer panel is located within said recess in said insulating member.

* * * * *